United States Patent [19]

Molnár

[11] Patent Number: 4,489,655

[45] Date of Patent: Dec. 25, 1984

[54] SEQUENTIAL BLASTING SYSTEM

[75] Inventor: Otto Molnár, Strand, South Africa

[73] Assignee: Bakke Industries Limited, South Africa

[21] Appl. No.: 456,098

[22] Filed: Jan. 6, 1983

[51] Int. Cl.[3] ..... F42D 1/06

[52] U.S. Cl. ..... 102/217

[58] Field of Search ..... 102/217, 200; 361/248-250; 307/41

[56] References Cited

U.S. PATENT DOCUMENTS

| | | | |
|---|---|---|---|
| 2,812,711 | 11/1957 | Cance et al. | 102/217 |
| 2,814,991 | 12/1957 | Cance | 102/217 |
| 4,099,467 | 7/1978 | MacKellar et al. | 102/217 |

*Primary Examiner*—Charles T. Jordan

*Attorney, Agent, or Firm*—Cahill, Sutton & Thomas

[57] ABSTRACT

A sequential blasting system includes a plurality of electrically fired detonators and a pyrotechnical activated switch associated with each detonator. On firing of a detonator, the associate pyrotechnical activated switch primes the sequentially next to be fired detonator. Alternate detonators are connected to first and second conductors, respectively, through an alternating sequencer, which sequencer alternatingly connects the first and second conductors with a source of electrical power to fire the detonator primed by the previously actuated pyrotechnical activated switch.

4 Claims, 3 Drawing Figures

SEQUENTIAL BLASTING SYSTEM

BACKGROUND OF THE INVENTION

The present invention relates to sequential blasting systems.

Various sequential blasting systems are known, each having its own characteristics and, in may cases disadvantages. One disadvantage in a case where a pyrotechnical activated switch (PAS) is used, is that there are possible delay variations in the PAS.

It is an object of the invention to suggest a system which will assist in overcoming this disadvantage.

SUMMARY OF THE INVENTION

According to the invention, a sequential blasting system includes (a) an electrical supply circuit including a common earth conductor, a first electrical conductor, and a second electrical conductor, all three conductors being connectable to a source of electrical energy;

(b) a series of detonator circuits in which a detonator circuit is provided for each detonator to be exploded, each such circuit including a first detonator conductor adapted to connect its detonator electrically to either of the first and the second electrical conductors, and a second detonator conductor adapted to connect its detonator electrically to the common earth conductor, such that the first detonator conductor of each alternate detonator circuit is connected to the first electrical conductor and the first detonator conductor of each of all other detonator circuits is connected to the second electrical conductor;

(c) a pyrotechnical activated switch (=PAS) for each detonator circuit including a bridge member, two control contacts and a firing part adapted to cause the bridge member to bridge the two control contacts when being energized by the supply of electricity to it, the two control contacts being located to interrupt either of the first detonator conductor and the second detonator conductor of its detonator circuit, and the firing part being connected in parallel to the detonator of the previous detonator circuit by connection to the first and second detonator of the previous detonator so that when current is supplied to one detonator, current is simultaneously also supplied to the firing part of the next PAS; and (d) connection means for connecting the first electrical conductor and the second electrical conductor to an alternating sequencer for supplying electrical current alternatingly to the first and second electrical conductors.

The detonator circuit for the first detonator to be exploded may have its first electrical conductor connected directly to either of the first and the second electrical conductors and its second detonator conductor connected directly to the common earth conductor, both connections being without an intermediate PAS.

The invention also extends to a sequential blasting system incorporating detonators and an alternating sequencer.

BRIEF DESCRIPTION OF THE DRAWINGS

The invention will now be described by way of example with reference to the accompanying schematic drawings.

In the drawings there is shown in

DESCRIPTION OF THE PREFERRED EMBODIMENT

Figure 1:
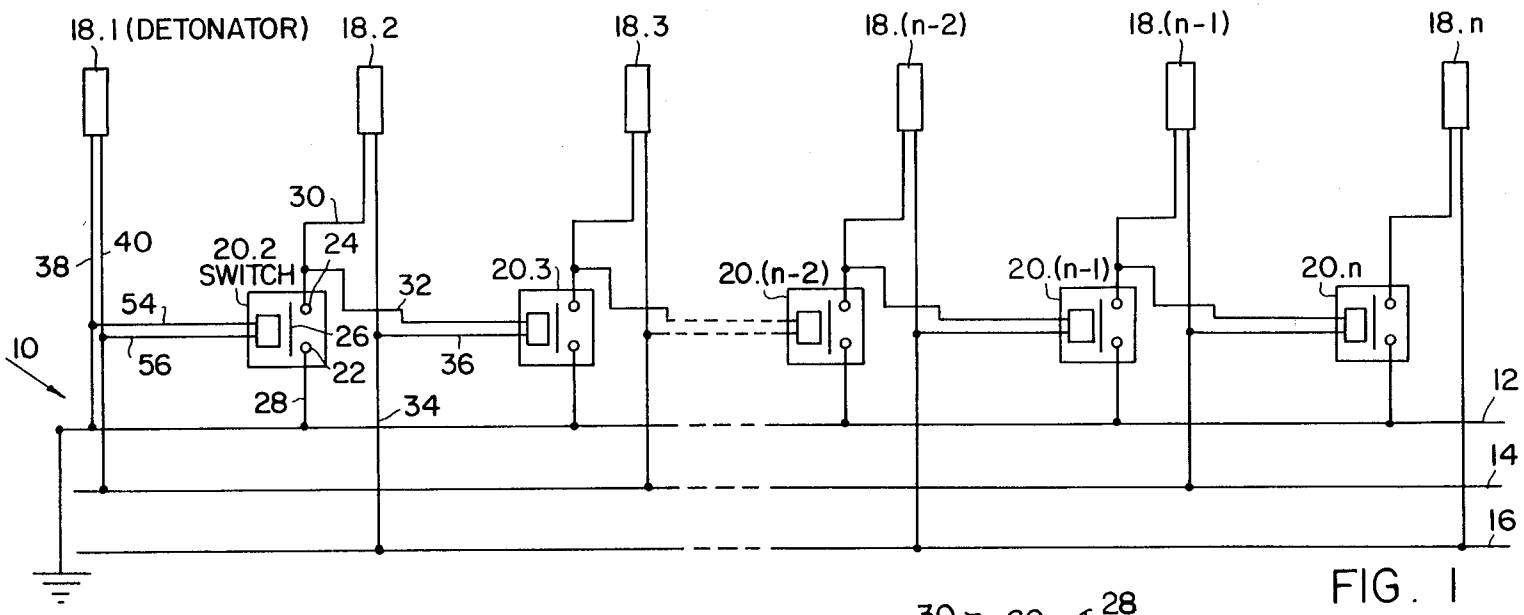
FIG. 1 a schematic layout of a sequential blasting system in accordance with the invention.

Referring to FIG. 1, the sequential blasting system includes a circuit 10, which has a common earth conductor 12, a first firing electrical conductor 14, and a second firing electrical conductor 16. The conductors 12, 14, 16 are connected to various detonators 18.1 . . . 18.n and pyrotechnical activated switches 20.2 . . . 20.n as shown.

Reference now will be made to PAS switch 20.2 only, but the other PAS switches operate in the same manner.

Figure 2:
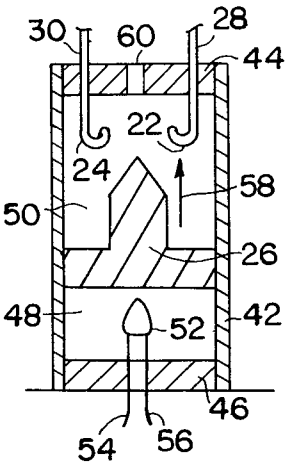
FIG. 2 on a larger scale, a sectional side view of a pyrotechnical activated switch (PAS) used in the system as illustrated in FIG. 1.

The PAS switch 20.2, as is also shown in FIG. 2, includes contact points 22 and 24, which are adapted to be bridged by a bridge member or switch piston 26. The contact point 22 is connected in each case by way of a first conductor 28 to the common earth conductor 12. The contact point 24 in each case is connected by way of the conductor 30 to its respective detonator 18.2. The contact point 24 is also connected via the conductor 32 to the next PAS 20.3. The detonator 18.2 is connected via conductor 34 to the conductor 16 and via conductor 36 to the next PAS 20.3. (The alternate detonators 18.3, 18.5, 18.7, etc. are respectively connected to the conductor 14).

The first detonator 18.1 is connected by means of the conductors 38 and 40 respectively to the earth conductor 12 and the conductor 14.

Referring again to FIG. 2, a pyrotechnical activated switch 20.2 is illustrated. The other PAS switches are similar. The PAS 20.2 includes a cylindrical body 42 closed by a first closure member 44 at one end and by a second closure member 46 at the opposite end. The conductors 30, 28 pass through the member 44 and terminate in the control contacts 24, 22. A bridge or switch piston 26 is sealingly and slidably mounted in the body 42, and divides the body into two chambers 48, 50. In the chamber 48 a firing part is provided as a match head (cerium) 52, which is coupled via the conductors 54, 56 to the conductors 38, 40 of the first detonator 18.1. When current flows through the match head 52, an explosion takes place and the piston 26 is forced in the direction indicated by arrow 58. Being made of electrical conducting material (eg. copper) the piston 26 bridges the contacts 24, 22. As is shown the member 44 has an aperture 60 for air to escape through when the piston 26 moves in the direction of arrow 58.

Figure 3:
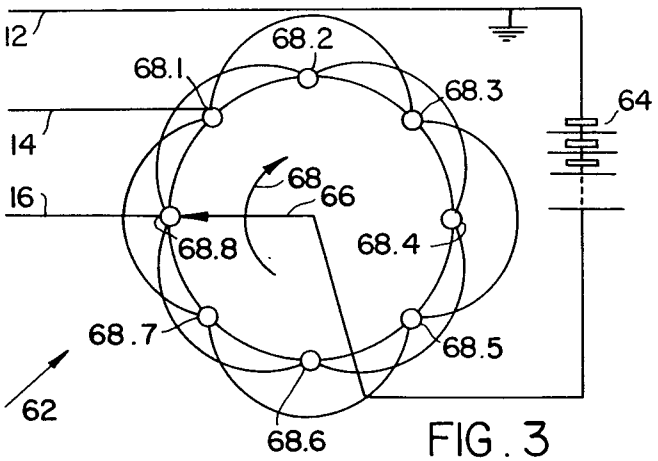
FIG. 3 a schematic view of a mechanical firing sequencer used in the system illustrated in FIG. 1.

The conductors 12, 14 and 16 are connected to a firing sequencer 62 as shown in FIG. 3. The firing sequencer 62 is connected to a source of electricity 64 and has a moving connection arm 66 rotatable in the direction indicated by arrow 68 by means of rotation means, eg. clock work, not shown. On rotation, the arm 60 comes into contact with the contacts 68.1 . . . 68.8. The contacts 68.1, 68.3, 68.5 and 68.7 are connected to the electrical conductor 14 whereas the contacts 68.2, 68.4, 68.6 and 68.8 are connected to the electrical conductor 16.

When the current from the source 64 is switched on and the driving means for the arm 66 starts rotating the arm 66, the only detonator, which does not have an interrupted current circuit, is the first detonator 18.1. Accordingly if the arm 66 makes contact with any contact point 68.1, 68.3, etc. (which are connected to the conductor 14) the detonator 18.1 will be energized first and will detonate. Simultaneously current is supplied via conductor 54, 56 to the switch 20.2, the match head 52 ignites and explodes so that the bridge 26 closes the contacts 22, 24. When the arm 66 reaches the next contact 68.2, 68.4, etc. of the conductor 16, current will be supplied to the detonator 18.2 and this results in the detonation of this detonator 18.2. Simultaneously current is supplied to the next PAS 20.3, and the next detonator 18.3 is exploded in the same manner. The same procedure is repeated until all detonators have been exploded.

The detonators of the sequential blasting system are connected in parallel to the firing conductors 14 and 16 by means of the pyrotechnical activated switches as shown. The purpose of having two firing conductors is to overcome the setting off simultaneously of the neighbouring charges. If the switching delay of the PAS is shorter than the pulse width of the firing pulse, the neighbouring charge will be eliminated. It can be seen that the interval between two detonations is determined only by the firing sequencer 62 since the setting off procedure is not dependent on the firing of the precedent firings.

The match head 52 of the pyrotechnical activated switches 20 may be similar to the type used in ordinary blasting caps or detonators. Such a match head is encapsulated in a plastic or metal container. Normally the totally enclosed types contain much less lead azide or styphanate in order to maintain the integrity of the device after firing. Reliability figures obtained from experience in the USA aerospace program is better than $10^{-4}$.

The firing sequencer 62 could be mechanically or electronically operable. With the present state of art of solid state electronics, it should not be problematic to design a reliable device with sufficient robustness for use in the mining industry.

I claim:

1. A sequential blasting system, which includes (a) an electrical supply circuit including a common earth conductor, a first electrical conductor, and a second electrical conductor, all three conductors being connectable to a source of electrical energy;

(b) a series of detonator circuits in which a detonator circuit is provided for each detonator to be exploded, each such circuit including a first detonator conductor adapted to connect its detonator electrically to either of the first and the second electrical conductors, and a second detonator conductor adapted to connect its detonator electrically to the common earth conductor, such that the first detonator conductor of each alternate detonator circuit is connected to the first electrical conductor and the first detonator conductor of each of all other detonator circuits is connected to the second electrical conductor;

(c) a pyrotechnical activated switch (=PAS) for each detonator circuit including a bridge member, two control contacts and a firing part adapted to cause the bridge member to bridge the two control contacts when being energized by the supply of electricity to it, the two control contacts being located to interrupt either of the first detonator conductor and the second detonator conductor of its detonator circuit, and the firing part being connected in parallel to the detonator of the previous detonator circuit by connection to the first and second detonator conductors of the previous detonator circuit so that when current is supplied to one detonator current is simultaneously also supplied to the firing part of the next PAS; and (d) connection means for connecting the first electrical conductor and the second electrical conductor to an alternating sequencer for supplying electrical current alternatingly to the first and second electrical conductors.

2. A system as claimed in claim 1, in which the detonator circuit for the first detonator to be exploded has its first electrical conductor connected directly to either of the first and the second electrical conductors and its second detonator conductor connected directly to the common earth conductor, both connections being without an intermediate PAS.

3. A sequential blasting system, which includes (a) an electrical supply circuit including a common earth conductor, a first electrical conductor, and a second electrical conductor, all three conductors being connectable to a source of electrical energy;

(b) a series of detonator circuits in which a detonator circuit is provided for each detonator to be exploded, each such circuit including a first detonator conductor adapted to connect its detonator electrically to either of the first and the second electrical conductors, and a second detonator conductor adapted to connect its detonator electrically to the common earth conductor, such that the first detonator conductor of each alternate detonator circuit is connected to the first electrical conductor and the first detonator conductor of each of all other detonator circuits is connected to the second electrical conductor;

(c) a pyrotechnical activated switch (=PAS) for each detonator circuit including a bridge member, two control contacts and a firing part adapted to cause the bridge member to bridge the two control contacts when being energized by the supply of electricity to it, the two control contacts being located to interrupt either of the first detonator conductor and the second detonator conductor of its detonator circuit, and the firing part being connected in parallel to the detonator of the previous detonator circuit by connection to the first and second detonator conductors of the previous detonator circuit so that when current is supplied to one detonator, current is simultaneously also supplied to the firing part of the next PAS; and (d) an alternating sequencer for supplying electrical current alternatingly to the first and second electrical conductors; and (e) connection means for connecting the first electrical conductor and the second electrical conductor to the alternating sequencer.

4. A sequential blasting system which includes (a) an electrical supply circuit including a common earth conductor, a first electrical conductor, and a second electrical conductor, all three conductors being connectable to a source of electrical energy;

(b) a series of detonators to be exploded in sequence;

(c) a series of detonator circuits, in which a detonator circuit is provided for each detonator to be exploded, each such circuit including a first detonator conductor adapted to connect its detonator electrically to either of the first and the second electrical conductors, and a second detonator conductor adapted to connect its detonator electrically to the common earth conductor, such that the first detonator conductor of each alternate detonator circuit is connected to the first electrical conductor and the first detonator conductor of each of all other detonator circuits is connected to the second electrical conductor;

(d) a pyrotechnical activated switch (=PAS) for each detonator circuit including a bridge member, two control contacts and a firing part adapted to cause the bridge member to bridge the two control contacts when being energized by the supply of electricity to it, the two control contacts being located to interrupt either of the first detonator conductor and the second detonator conductor of its detonator circuit, and the firing part being connected in parallel to the detonator of the previous detonator circuit by connection to the first and second detonator conductors of the previous detonator circuit so that when current is supplied to one detonator, current is simultaneously also supplied to the firing part of the next PAS; and (e) an alternating sequencer for supplying electrical current alternatingly to the first and second electrical conductors; and (f) connection means for connecting the first electrical conductor and the second electrical conductor to the alternating sequencer.

* * * * *